US006098714A

United States Patent [19]

Deaton

[11] Patent Number: 6,098,714

[45] Date of Patent: Aug. 8, 2000

[54] HYDRAULIC FLUID ACTUATOR WITH METAL TO METAL SEALS

[75] Inventor: Thomas M. Deaton, Houston, Tex.

[73] Assignee: Halliburton Energy Services, Inc., Dallas, Tex.

[21] Appl. No.: 09/129,177

[22] Filed: Jul. 17, 1998

Related U.S. Application Data

[60] Provisional application No. 60/053,134, Jul. 18, 1997.

[51] Int. Cl.[7] ..... E21B 34/10

[52] U.S. Cl. ..... 166/321; 166/374; 251/58

[58] Field of Search ..... 166/319, 321, 166/374; 251/58

[56] References Cited

U.S. PATENT DOCUMENTS

| | | | |
|---|---|---|---|
| 4,069,871 | 1/1978 | Page, Jr. | 166/321 |
| 4,452,310 | 6/1984 | Pringle et al. | 166/319 |
| 4,986,357 | 1/1991 | Pringle | 166/319 |
| 5,101,904 | 4/1992 | Gilbert | 166/319 |
| 5,318,127 | 6/1994 | Hines et al. | 166/321 |
| 5,503,913 | 4/1996 | Carmody | 166/319 |

FOREIGN PATENT DOCUMENTS 2 169 332 7/1986 United Kingdom .

2 218 133 11/1989 United Kingdom .

OTHER PUBLICATIONS

International Search Report dated Nov. 11, 1998 from Patent Cooperation Treaty re International Application No. PCT/US98/14855.

*Primary Examiner*—George Suchfield
*Attorney, Agent, or Firm*—Paul I. Herman; Marlin R. Smith

[57] ABSTRACT

An improved fluid actuator is provided. The fluid actuator (25) comprises a variable volume fluid chamber (124). A first tube (162) is fixed within the variable volume fluid chamber (124). The first tube (162) has a first sealing surface (142) and a second sealing surface (144). A piston (100) is slidably disposed within the variable volume fluid chamber (124) and slidably movable over the first tube (162) between a first position and a second position. The piston (100) comprises a first sealing surface (140) and a second sealing surface (146). The piston first sealing surface (140) and the first tube first sealing surface (142) cooperate to form a seal between the piston (100) and the first tube (162) when the piston (100) is in the first position. The piston second sealing surface (146) and the first tube second sealing surface (144) cooperate to form a seal between the piston (100) and the first tube (162) when the piston (100) is in the second position.

20 Claims, 2 Drawing Sheets

HYDRAULIC FLUID ACTUATOR WITH METAL TO METAL SEALS

CROSS-REFERENCE TO RELATED APPLICATIONS

This application claims priority under 35 USC § 119(e) of provisional application number 60/053,134, filed Jul. 18, 1997.

TECHNICAL FIELD OF THE INVENTION

This invention relates generally to actuators, and more particularly to a hydraulic fluid actuator with metal to metal seals.

BACKGROUND OF THE INVENTION

Actuators are used in a number of industries and applications, from elevators and automotive jacks to construction equipment and robots. Hydraulic fluid actuators, or fluid actuators, generally operate by converting fluid pressure into linear motion. Fluid actuators generally utilize a liquid, such as hydraulic oil, or a gas, such as air, as the operating fluid for converting the fluid pressure into motion.

To illustrate the operation of a typical fluid actuator, the operation of a surface controlled subsurface safety valve as used in the oil and gas industry is described. A surface controlled subsurface safety valve is generally located deep in a producing well as part of a production tubing string. The subsurface safety valve acts as a downhole flow control device to block well fluid flow during emergency conditions. The subsurface safety valve is generally controlled from the well surface by the application of hydraulic pressure to the subsurface safety valve.

Hydraulic pressure is communicated through a high pressure line to a fluid actuator contained within the subsurface safety valve. A biasing system contained within the subsurface safety valve produces a force on the fluid actuator to compress the fluid actuator. When fluid pressure from the well surface is applied, the fluid actuator overcomes the force exerted by the biasing system and extends the fluid actuator and opens the subsurface safety valve to allow well fluid to flow through the subsurface safety valve to the well surface. Upon removal of the fluid pressure from the well surface, the load exerted by the biasing system compresses the fluid actuator, and closes the subsurface safety valve to block the flow of well fluid to the well surface.

Conventional fluid actuators are often prone to damage due to contamination from the environment. For example, in the case of fluid actuators used in subsurface safety valves, the high pressure/heat environment in addition to the caustic chemicals found in the well can damage the seals within the fluid actuator. Accordingly, the control fluid may be contaminated with environmental contaminates and the control fluid may leak from the fluid actuator.

Conventional fluid actuators often have seals fabricated with plastics that are prone to wear during use. Accordingly, the fluid actuator must be removed from service and disassembled to replace the seals. Depending upon the application, removal and replacement of the fluid actuator can be extremely expensive.

SUMMARY OF THE INVENTION

Accordingly, a need has arisen for an improved fluid actuator. The present invention provides an improved fluid actuator that substantially eliminates or reduces problems associated with prior methods and systems.

In accordance with one embodiment of the present invention, an improved fluid actuator is provided. The improved fluid actuator comprises a variable volume fluid chamber having a first tube fixed therein. The first tube has an internal passage, a first sealing surface, and a second sealing surface. A piston having a first end and a second end is slidably disposed within the variable volume fluid chamber and slidably disposed over the first tube. The first end of the piston forms a piston cavity having a first sealing surface and a second sealing surface. The piston first sealing surface and the first tube first sealing surface cooperate to form a seal between the piston and the first tube when the piston is in a first position. The piston second sealing surface and the first tube second. sealing surface cooperate to form a seal between the piston and the first tube when the piston is in a second position. In a particular embodiment, the sealing surfaces of the piston and the fist tube are formed from metal.

Technical advantages of the present invention comprise providing a fluid actuator that blocks outside contaminates entering the fluid actuator. Accordingly, contaminates are not introduced into the control fluid system that controls the operation of the fluid actuator. Another technical advantage of the present invention is that the sealing surfaces are not as easily damaged as seals used in conventional fluid actuators.

A further technical advantage of the present invention is that the seals may form metal-to-metal seals which are beneficial for several reasons. First, the metal-to-metal seals are not subject to damage as easily as seals made from other materials. Second, the metal-to-metal sealing surfaces have increased durability and have a longer service life, thereby decreasing the cost associated with the fluid actuator. A further benefit of metal-to-metal seals is that the fluid actuator can be used in high temperature/pressure conditions and in severe environments, such as those found in oil and gas downhole tool applications.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following description, taken in conjunction with the accompanying drawings, wherein like reference numerals represent like parts, in which.

DETAILED DESCRIPTION OF THE INVENTION

FIGS. 1 through 4 illustrate an improved fluid actuator in accordance with the present invention. Although the improved fluid actuator is described in terms of a surface controlled subsurface safety valve, the improved fluid actuator may be utilized in any number of applications without departing from the scope of the present invention. For example, the improved fluid actuator may be used in pneumatic systems, and other suitable hydraulic applications.

As described in greater detail below, the improved fluid actuator comprises a variable volume fluid chamber that has a first tube fixed within the variable volume fluid chamber. A piston is slidably positioned within the variable volume fluid chamber and slidably positioned over the first tube. Sealing surfaces on the piston and the first tube cooperate to form a seal between the piston and the first tube when the piston is in a first position and a second position. The seals prevent outside contaminates from entering the fluid actuator and commingling with a control fluid used in the operation of the fluid actuator. Accordingly, the fluid actuator has a longer operating life with greater reliability.

Figure 1:
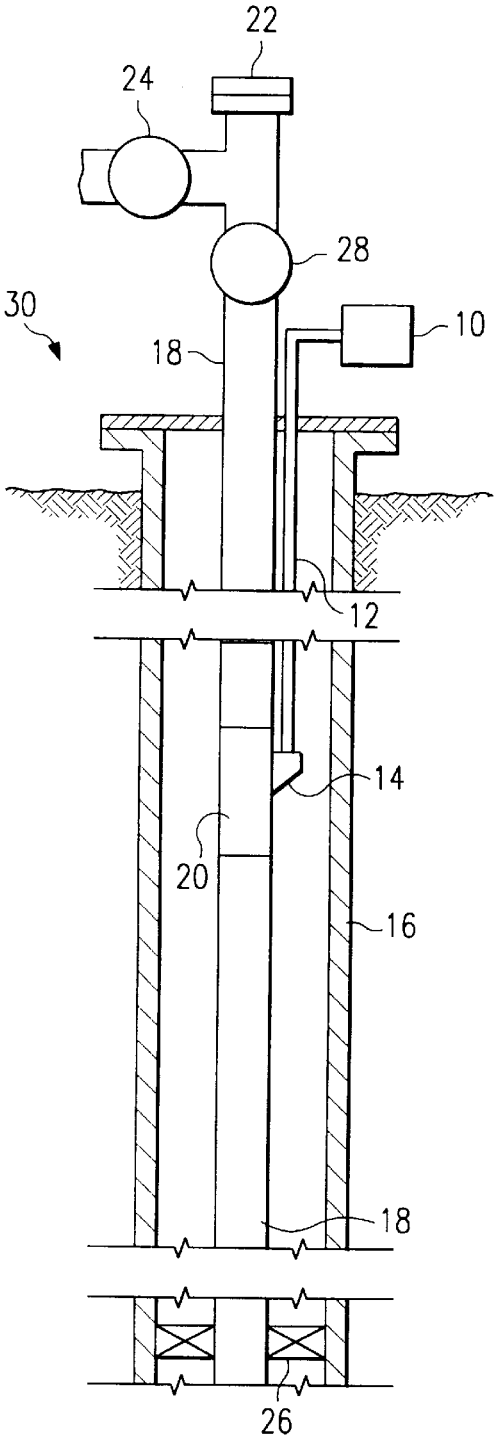
FIG. 1 is a schematic view in section illustrating a typical producing oil or gas well with a surface controlled subsurface safety valve in accordance with the present invention.

FIG. 1 is a schematic view of a typical producing oil or gas well 30. The well 30 comprises a production tubing string 18 and a casing 16 which extends from the surface of the well 30 to an oil and gas bearing rock formation (not expressly shown) deep underground. A packing material 26 is preferably located above the oil or gas producing formation between the production tubing string 18 and the casing 16 to direct the flow of formation fluid or well fluids to the surface through the production tubing string 18. The formation fluid or well fluid enters the production tubing string 18 below the packing material 26 through perforations (not expressly shown) in the casing 16. A surface controlled subsurface safety valve 20 is disposed within the production tubing string 18 as an integral part thereof such that the well fluid must flow through the subsurface safety valve 20. The subsurface safety valve 20 is operated by a control system 10 which typically comprises a hydraulic pump (not expressly shown) to supply a high pressure control fluid (not expressly shown), such as hydraulic fluid. The high pressure control fluid is generally supplied to the subsurface safety valve 20 by a control line 12 and a connector 14.

Valves 24 and 28 are preferably provided at the surface of the well 30 to control the flow of well fluids from the production tubing string 18. A well cap 22 is also provided to allow access to the interior of the production tubing string 18 for maintenance and inspection.

Figure 4:
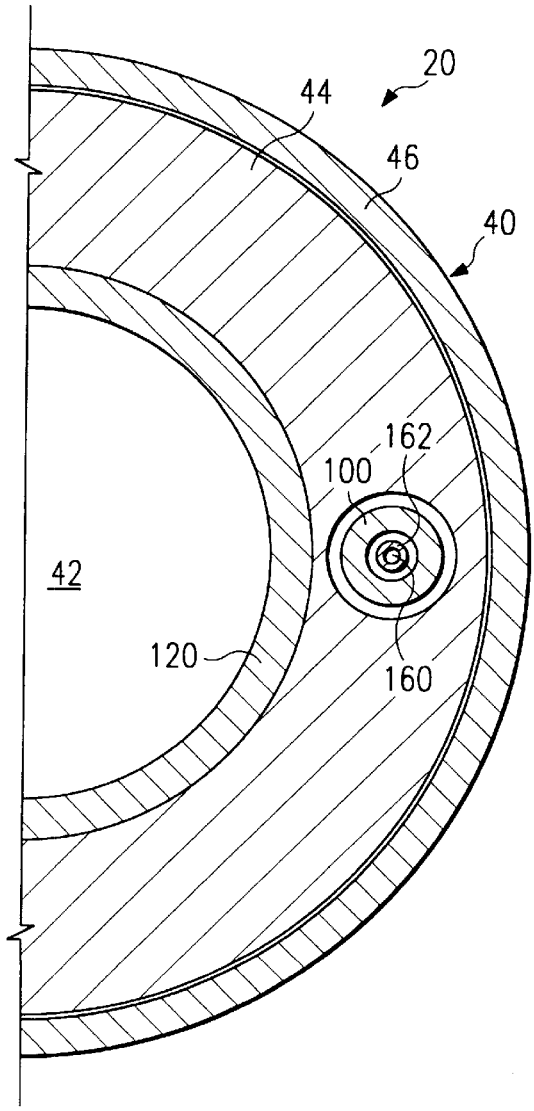
FIG. 4 is a drawing in section taken along lines 4—4 of FIG. 2.
Figure 2:
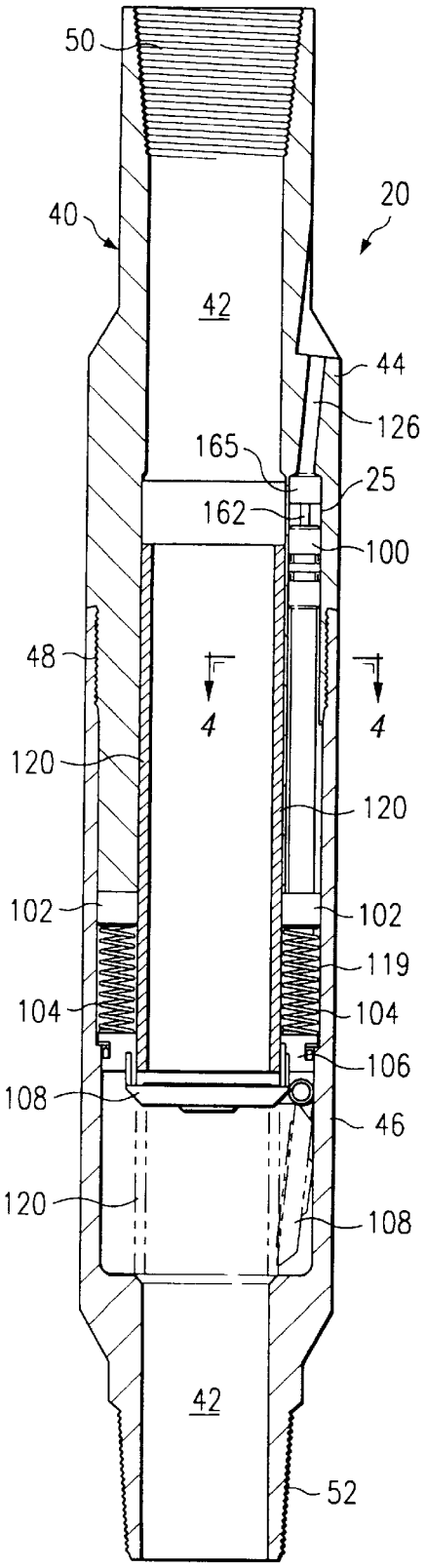
FIG. 2 is a schematic drawing in section with portions broken away illustrating a surface controlled subsurface safety valve with a fluid actuator in accordance with the present invention.
Figure 3:
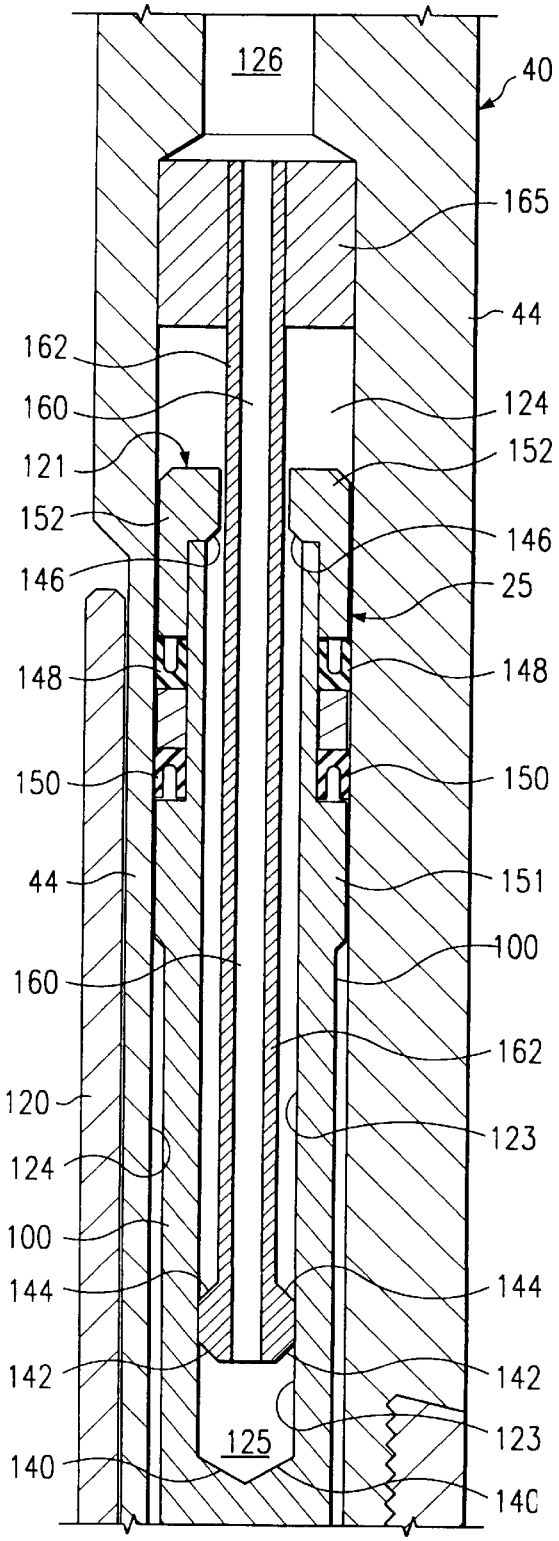
FIG. 3 is an enlarged drawing in section with portions broken away illustrating the fluid actuator of FIG. 2.

FIGS. 2, 3, and 4 illustrate various views of the subsurface safety valve 20 in accordance with one embodiment of the present invention. FIGS. 2 and 3 are schematic drawings in longitudinal section with portions broken away of the subsurface safety valve 20. FIG. 4 is a cross section of the subsurface safety valve 20 of FIG. 2 taken along line 4—4 of FIG. 2. The subsurface safety valve 20 comprises a housing assembly 40 that has a generally hollow, cylindrical configuration with a longitudinal bore 42 extending therethrough. As best illustrated in FIG. 2, the housing assembly 40 is defined, in part, by an upper housing subassembly 44 and a lower housing subassembly 46. The housing subassemblies 441 and 46 are concentrically joined with each other by a threaded connection 48. Threaded connections 50 and 52 are provided on opposite ends of the housing assembly 40 for use in connecting the subsurface safety valve 20 within the production tubing string 18.

The subsurface safety valve 20 also comprises a fluid actuator 25 disposed within the housing subassembly 44. The fluid actuator 25 is coupled to the surface of the well 30 by a fluid passage 126 that is coupled to a connector 14 and a control line 12. As best illustrated in FIG. 4, the fluid actuator 25 comprises a variable volume fluid chamber 124 formed within the wall of the upper housing subassembly 44. For the embodiment shown in FIG. 3, a first tube 162 is a cylindrical tube disposed and secured within the variable volume fluid chamber 124 by a bushing 165. The first tube 162 is fixed relative to the fluid passage 125 and the variable volume fluid chamber 124. The first tube 162 has an internal passage 160 that is coupled to the fluid passage 126. A first sealing surface 142 and a second sealing surface 144 are disposed on the outer surface of the first tube 162.

As best illustrated in FIG. 2, the fluid actuator 25 also comprises a piston 100. In the embodiment illustrated, the piston 100 is generally cylindrical in configuration and has a first end 121. The piston 100 may also comprise a second tube 151 and a guide 152. The second tube 151 is generally cylindrical in configuration. The guide 152 is typically coupled to the second tube 151 and forms the first end 121 of the piston 100. A piston cavity 123 is defined by the interior surface of the second tube 151 and the interior surface of the guide 152. The piston 100 further comprises a first sealing surface 140 and a second sealing surface 146 defined within the piston cavity 123. The second tube 151 and the guide 152 allow limited movement of the piston 100 in relation to the first tube 162.

The sealing surfaces 140, 142, 144, and 146 may individually, or in corresponding pairs, be manufactured from metal that allows for metal-to-metal sealing of the fluid actuator 25. It will be understood that the sealing surfaces 140, 142, 144, and 146 may be manufactured from other suitable materials without departing from the scope of the present invention. For example, the sealing surfaces 140, 142, 144, and 146 may be fabricated from a ceramic material, composite material, plastic material, or any other suitable sealing material.

The first tube 162 is disposed, in part, within the piston cavity 123 of the piston 100. The piston 100 is slidably disposed within the variable volume fluid chamber 124 and slides over the first tube 162 between a first position and a second position. Seals 148 and 150 are disposed on the exterior surface of the piston 100 and form a seal between the piston 100 and the variable volume fluid chamber 124 of the upper housing subassembly 44. For the embodiment illustrated, the piston 100 is connected to a sleeve 120.

The sleeve 120 is slidably disposed within the housing assembly 40. The sleeve 120 has a generally hollow, cylindrical configuration. A biasing system 119 is contained within an annular area formed between the inside diameter of the housing assembly 40 and the outside diameter of the sleeve 120. The biasing system 119 provides a biasing force that biases the sleeve 120 and the fluid actuator 25 in the first position. For the embodiment shown in FIG. 2, the annular area is formed in the lower housing subassembly 46.

One embodiment of a biasing system 119 comprises a compression ring 102 and a support 106 disposed within the annular area of the lower housing subassembly 46. The compression ring 102 is coupled to the second end of the piston 100. A spring system, which may comprise at least one spring 104 may be disposed within the annular area between the support 106 and the compression ring 102. The springs 104 act on the compression ring 102 to provide the biasing force to maintain the sleeve 120 in a non-extended or first position. The support 106 may comprise a hinge mechanism for a flapper type valve mechanism 108.

The solid lines in FIGS. 2 illustrate the sleeve 120 in a non-extended or first position. With the sleeve 120 in the first position, the flapper type valve mechanism 108 closes in response to pressure from well fluid flowing through the production tubing string 18. The dotted lines in FIG. 2 illustrate the sleeve 120 in the extended or second position. The sleeve 120 extends and forces open the flapper type valve mechanism 108. With the flapper type valve mechanism 108 open and the sleeve 120 fully extended, a full bore passage 44 is provided through the subsurface safety valve 20 to allow well fluid to pass unrestricted through the production tubing string 18 to the surface of the well 30.

The operation of the fluid actuator 25 as used in the subsurface safety valve 20 is described below. The biasing system 119 acts on the compression ring 102 and biases the sleeve 120 and the fluid actuator 25 in a non-extended or first position. In the first position, the first sealing surface 140 of the piston 100 and the first sealing surface 142 of the first tube 162 cooperate to form a seal between the piston 100 and the first tube 162, thereby sealing the fluid actuator 25 from contamination.

The second position is reached by applying a high pressure control fluid, such as hydraulic fluid, from the control system 10 at the surface of the well 30 to the subsurface safety valve 20 through the control line 12 and the connector 14. The high pressure control fluid enters the variable volume-fluid chamber 124 and the piston cavity 123 through the fluid passage 126 and the internal passage 160 of the first tube 162. The high pressure control fluid in the variable volume fluid chamber 124 and the piston cavity 123 acts on the piston 100, forming a longitudinal force on the piston 100, which compresses the springs 104 through the compression ring 102 and moves the piston 100 and the sleeve 120 to the second position. In the second position, the second sealing surface 146 of the piston 100 and the second sealing surface 144 of the first tube 162 cooperate to form a seal between the piston 100 and the first tube 162, thereby sealing the fluid system from contamination when the fluid actuator 25 is extended, or in the second position.

Although the present invention has been described with multiple embodiments, various changes and modifications may be suggested to one skilled in the art. It is intended that the present invention encompass such changes and modifications as fall within the scope of the following claims.

What is claimed is:

1. An improved fluid actuator comprising:

a variable volume fluid chamber;

a first tube fixed within the variable volume fluid chamber, the first tube comprising a first sealing surface and a second sealing surface disposed on an outer surface of the first tube;

a piston having a first and a second sealing surface, the piston slidably disposed within the variable volume fluid chamber and slidably disposed over the first tube between a first position and a second position;

wherein the piston first sealing surface and the first tube first sealing surface cooperate to form a seal between the piston and the first tube when the piston is in the first position; and wherein the piston second sealing surface and the first tube second sealing surface cooperate to form a seal between the piston and the first tube when the piston is in the second position.

2. The fluid actuator of claim 1, wherein the piston further comprises a second tube and a guide.

3. The fluid actuator of claim 1, wherein the first and second sealing surfaces of the first tube are fabricated from metal.

4. The fluid actuator of claim 1, wherein the first and second sealing surfaces of the piston are fabricated from metal.

5. The fluid actuator of claim 1, wherein the first and second sealing surfaces of the first tube and the first and second sealing surfaces of the piston are fabricated from metal.

6. The fluid actuator of claim 1, wherein the fluid actuator is disposed within a subsurface safety valve.

7. The fluid actuator of claim 6, wherein the piston is coupled to a sleeve.

8. A downhole tool for controlling a downhole effector used in a well, the downhole tool comprising:

a cylindrical body having an inside diameter and an outside diameter which define a wall of the cylindrical body;

a fluid actuator disposed within the wall of the cylindrical body, the fluid actuator comprising:

a variable volume fluid chamber;

a first tube fixed within the variable volume fluid chamber, the first tube comprising a first sealing surface and a second sealing surface;

a piston having a first sealing surface and a second sealing surface, the piston slidably disposed within the variable volume fluid chamber and slidably disposed over the first tube, the piston movable between a first position and a second position;

wherein the piston first sealing surface and the first tube first sealing surface cooperate to form a seal between the piston and the first tube when the piston is in the first position; and wherein the piston second sealing surface and the first tube second sealing surface cooperate to form a seal between the piston and the first tube when the piston is in the second position; and the piston coupled to the downhole effector.

9. The downhole tool of claim 8, wherein the piston further comprises a second tube and a guide.

10. The downhole tool of claim 8, wherein the first and second sealing surfaces of the first tube are manufactured from metal.

11. The downhole tool of claim 8, wherein the first and second sealing surfaces of the piston are fabricated from metal.

12. The downhole tool of claim 8, wherein the first and second sealing surfaces of the first tube and the first and second sealing surfaces of the piston are fabricated from metal.

13. The downhole tool of claim 8, wherein the downhole tool is a subsurface safety valve.

14. The downhole tool of claim 8, wherein the downhole effector is a sleeve.

15. A subsurface safety valve, comprising:

a housing assembly having a longitudinal axis;

a fluid actuator disposed within a wall of the housing assembly, the fluid actuator comprising:

a variable volume fluid chamber;

a first tube fixed within the variable volume fluid chamber, and having a first and a second sealing surface;

a piston slidably disposed within the variable volume fluid chamber and slidably movable over the first tube, the piston movable between a compressed position and an extended position, the piston comprising a first and a second sealing surface;

wherein the piston first sealing surface and the first tube first sealing surface cooperate to form a seal between the piston and the first tube when the piston is in the compressed position; and wherein the piston second sealing surface and the first tube second sealing surface cooperate to form a seal between the piston and the first tube when the piston is in the extended position;

a sleeve coupled to the piston and slidably disposed within the housing assembly;

a flapper type valve mechanism disposed within the housing assembly, the sleeve acting on the flapper type valve mechanism to move the flapper type valve mechanism between an open position and a closed position;

a biasing system acting on the piston to bias the piston in the compressed position, the compressed position of the piston corresponding to the closed position of the flapper valve; and wherein the fluid actuator is operable to overcome the biasing system and move the piston to the extended position, the second position of the piston corresponding to the open position of the flapper valve.

16. The subsurface safety valve of claim 15, wherein the first and second sealing surfaces of the first tube are manufactured from metal.

17. The subsurface safety valve of claim 15, wherein the first and second sealing surfaces of the piston are manufactured from metal.

18. The subsurface safety valve of claim 15, wherein the first and second sealing surfaces of the first tube and the first and second sealing surfaces of the piston are manufactured from metal.

19. The subsurface safety valve of claim 15, wherein the piston further comprises a second tube and a guide.

20. The subsurface safety valve of claim 15, wherein the biasing system comprises at least one spring.

* * * * *